US006840595B2

(12) United States Patent
Kusunoki

(10) Patent No.: US 6,840,595 B2
(45) Date of Patent: Jan. 11, 2005

(54) INK JET RECORDING APPARATUS

(75) Inventor: Ryutaro Kusunoki, Mishima (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/175,205

(22) Filed: Jun. 19, 2002

(65) Prior Publication Data

US 2003/0001912 A1 Jan. 2, 2003

(30) Foreign Application Priority Data

Jun. 25, 2001 (JP) ..... 2001-191800

(51) Int. Cl.[7] ..... B41J 29/38; B41J 2/045; B41J 3/00; B41J 2/04

(52) U.S. Cl. ..... 347/10; 347/11; 347/68; 347/69; 347/70; 347/71; 347/9; 347/54

(58) Field of Search ..... 347/10, 11, 68, 347/69, 70, 71, 2, 9

(56) References Cited

U.S. PATENT DOCUMENTS

| | | | | | |
|---|---|---|---|---|---|
| 4,284,996 | A | * | 8/1981 | Greve | 347/11 |
| 4,424,520 | A | * | 1/1984 | Matsuda et al. | 347/11 |
| 4,513,299 | A | | 4/1985 | Lee et al. | |
| 4,563,689 | A | * | 1/1986 | Murakami et al. | 347/11 |
| 4,752,790 | A | * | 6/1988 | Scardovi | 347/10 |
| 4,972,211 | A | * | 11/1990 | Aoki | 347/11 |
| 5,155,498 | A | * | 10/1992 | Roy et al. | 347/11 |
| 5,170,177 | A | * | 12/1992 | Stanley et al. | 347/11 |
| 5,221,931 | A | | 6/1993 | Moriyama | |
| 5,363,689 | A | * | 11/1994 | Hoffmann et al. | 73/1.17 |
| 5,461,493 | A | | 10/1995 | Venable | |
| 5,736,993 | A | * | 4/1998 | Regimbal et al. | 347/11 |
| 6,029,896 | A | * | 2/2000 | Self et al. | 239/4 |
| 6,092,886 | A | * | 7/2000 | Hosono | 347/10 |
| 6,123,405 | A | * | 9/2000 | Temple et al. | 347/10 |
| 6,174,038 | B1 | * | 1/2001 | Nakazawa et al. | 347/10 |
| 6,196,664 | B1 | * | 3/2001 | Kanda et al. | 347/46 |
| 6,217,159 | B1 | * | 4/2001 | Morikoshi et al. | 347/71 |
| 6,382,754 | B1 | * | 5/2002 | Morikoshi et al. | 347/11 |
| 6,409,295 | B1 | | 6/2002 | Norigoe | |
| 6,422,684 | B1 | * | 7/2002 | Ladabaum et al. | 347/46 |
| 6,702,414 | B2 | * | 3/2004 | Okuda | 347/10 |
| 2001/0002836 | A1 | | 6/2001 | Tanaka et al. | |

FOREIGN PATENT DOCUMENTS

| | | | | |
|---|---|---|---|---|
| EP | 636477 | A2 * | 2/1995 | B41J/2/015 |
| EP | 0 738 602 | A2 | 10/1996 | |
| EP | 916505 | A1 * | 5/1999 | B41J/2/205 |
| EP | 1 106 356 | A1 | 6/2001 | |
| JP | 61-22959 | | 1/1986 | |
| JP | 64-26454 | | 1/1989 | |
| JP | 4-250045 | A | 9/1992 | |
| JP | 11-216880 | A | 8/1999 | |
| JP | 2001-219556 | A | 8/2001 | |

* cited by examiner

*Primary Examiner*—Lamson Nguyen
*Assistant Examiner*—Leonard Liang
(74) *Attorney, Agent, or Firm*—Frishauf, Holtz, Goodman & Chick, P.C.

(57) ABSTRACT

An ink jet recording apparatus according to the present invention includes a pressure chamber stored with ink, a nozzle communicating with the pressure chamber and capable of discharging the ink from the pressure chamber, and an actuator for increasing and reducing the capacity of the pressure chamber in response to driving signals from a driving signal generator. The driving signal generator successively generate, an expansion pulse for increasing the capacity of the pressure chamber and a contraction pulse for reducing the capacity of the pressure chamber with a timing such that a time lag between the respective centers of the expansion pulse and the contraction pulse matches the resonance period of a meniscus generated in the nozzle by the ink in the pressure chamber. Thus, the ink jet recording apparatus continuously discharges a plurality of ink drops through the nozzle to form a pixel.

6 Claims, 4 Drawing Sheets

Initial state 0.5 Tc after start of operation

Tc after start of operation 1.5 Tc after start of operation

INK JET RECORDING APPARATUS

CROSS-REFERENCE TO RELATED APPLICATIONS

This application is based upon and claims the benefit of priority from the prior Japanese Patent Application No. 2001-191800, filed Jun. 25, 2001, the entire contents of which are incorporated herein by reference.

BACKGROUND OF THE INVENTION

1. Field of the Invention

The present invention relates to an ink jet recording apparatus for gradational printing such that a plurality of ink drops are continuously discharged through nozzles.

2. Description of the Related Art

Conventionally known is an ink jet recording apparatus in which an actuator composed of an electromechanical transducer such as a piezoelectric element is operated by means of driving signals to increase or reduce the capacity of a pressure chamber that is stored with ink, whereby the ink is discharge through nozzles to print a pixel by gradation. Ink jet recording apparatuses of this type are described in Jpn. Pat. Appln. KOKAI Publication No. 4-250045 and U.S. Pat. No. 4,513,299, for example.

In the ink jet recording apparatus described in Jpn. Pat. Appln. KOKAI Publication No. 4-250045, the voltage or pulse width of driving signals is changed to vary the volume of each ink drop that is discharged through a nozzle, whereby the dot size of each ink drop that is dashed against a recording medium can be changed for gradational printing.

In the ink jet recording apparatus described in U.S. Pat. No. 4,513,299, the number of driving pulses is controlled to discharge a plurality of ink droplets through nozzles and change the number of droplets to be discharged, whereby the dot size of each ink drop that is dashed against a recording medium can be changed for gradational printing.

In the case of the former gradational printing, it is hard considerably to change the volume of each discharged ink drop. Therefore, the latter gradational printing is superior to the former one in changing the dot size at a high rate.

In the latter gradational printing, compared with the former one in which the volume of one discharged ink drop is controlled to form one pixel, however, a plurality of ink droplets must be discharged at a higher driving frequency. In order to prevent lowering of the speed of the latter gradational printing, therefore, the droplets must be discharged by means of driving pulses with a considerably high frequency.

If these driving pulses are continuously applied to the actuator, vibration of meniscuses in the nozzles that are generated by means of driving pulses for discharging directly preceding ink droplets is followed by vibration of meniscuses that are generated by means of driving pulses for discharging subsequent droplets. Accordingly, the vibration of the meniscuses becomes so intensive and disturbing that ink in the nozzles involves air bubbles. If the ink in the nozzles thus involves air bubbles, the speed of discharge of ink drops lowers, and in some cases, no ink drops can be discharged.

BRIEF SUMMARY OF THE INVENTION

The object of the present invention is to provide an ink jet recording apparatus capable of minimizing the possibility of ink in nozzles involving air bubbles even when gradational printing is carried out in a manner such that a plurality of ink droplets are continuously discharged to change the dot size.

An ink jet recording apparatus according to an aspect of the invention comprises a pressure chamber stored with ink, a nozzle communicating with the pressure chamber and capable of discharging the ink from the pressure chamber, an actuator for increasing and reducing the capacity of the pressure chamber in response to driving signals and continuously discharging a plurality of ink drops through the nozzle to form a pixel, and a driving signal generator for successively generating, an expansion pulse for increasing the capacity of the pressure chamber and a contraction pulse for reducing the capacity of the pressure chamber with a timing such that a time lag between the respective centers of the expansion pulse and the contraction pulse matches the resonance period of a meniscus generated in the nozzle by the ink in the pressure chamber.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 1:
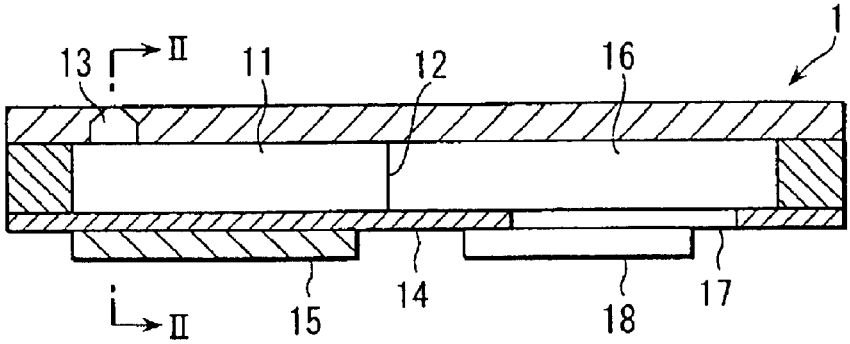
FIG. 1 is a view showing the configuration of the principal mechanism of an ink jet recording apparatus according to an embodiment of the invention.
Figure 2:
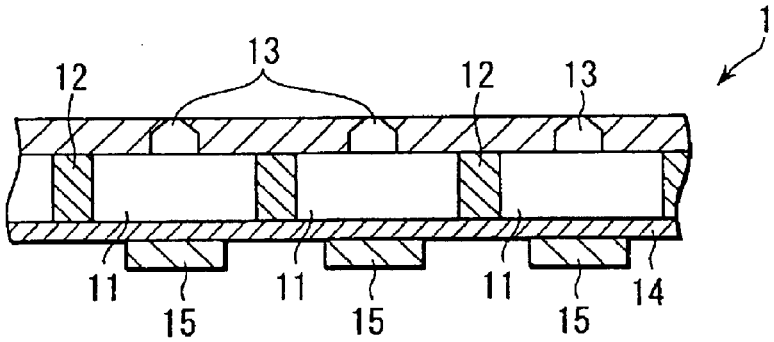
FIG. 2 is a sectional view of an ink jet head taken along line II—II of FIG. 1.

FIGS. 1 and 2 are views showing the configuration of the principal mechanism of an ink jet recording apparatus. In these drawings, numeral 1 denotes an ink jet head 1. FIG. 2 is a sectional view taken along line II—II of FIG. 1.

The ink jet head 1 is formed by dividing a plurality of pressure chambers 11 for ink storage by means of partition walls 12. Each pressure chamber 11 is provided with a nozzle 13 for discharging ink drops. The base of each pressure chamber 11 is formed of a vibration plate 14. A piezoelectric member 15 is fixed on the base side of the vibration plate 14 corresponding to each pressure chamber 11. The vibration plate 14 and the piezoelectric member 15 constitute an actuator.

The ink jet head 1 is formed having a common pressure chamber 16 that communicates with each pressure chamber 11. Ink is injected from an ink supply unit (not shown) into the chamber 16 through an ink supply port 17, whereby the common pressure chamber 16, pressure chambers 11, and nozzles 13 are filled with ink. As the pressure chambers 11 and the nozzles 13 are filled with ink, a meniscus of ink is formed in each nozzle 13. Further, a temperature sensor 18 as a temperature detector is attached to the back of the common pressure chamber 16.

Figure 3:
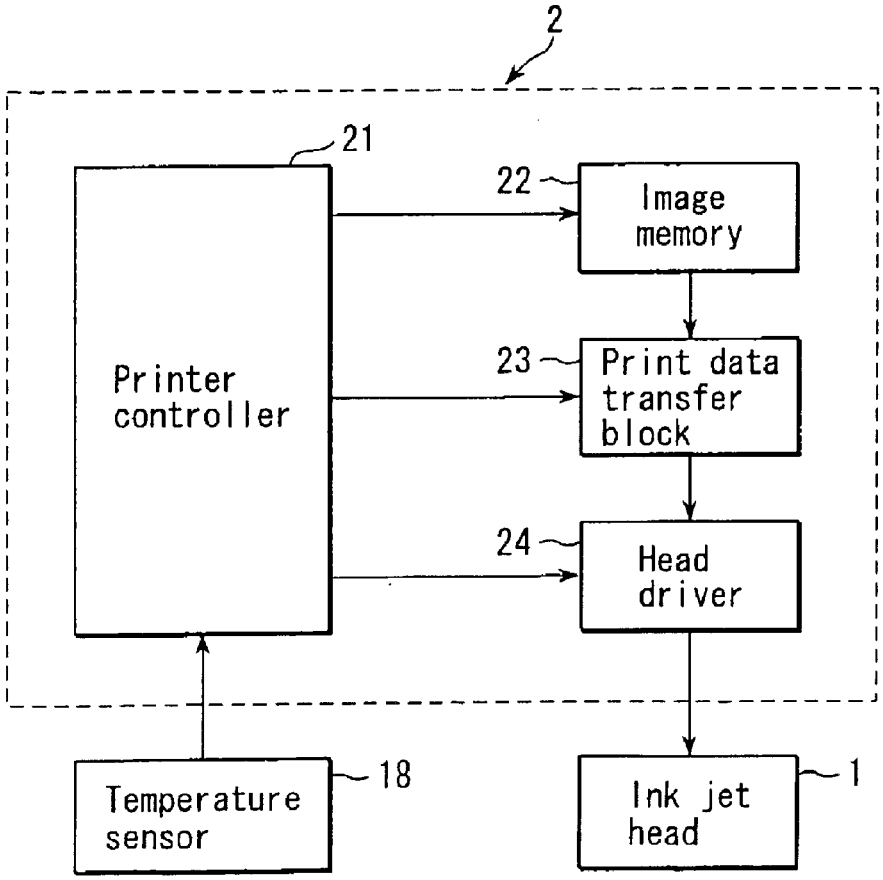
FIG. 3 is a diagram showing the configuration of a driving signal generator of the ink jet head.

FIG. 3 is a block diagram showing the configuration of the principal mechanism of a driving signal generator 2 for driving the ink jet head 1. The principal mechanism of the generator 2 is composed of a printer controller 21, image memory 22, print data transfer block 23, and head driver 24.

The printer controller 21 loads the image memory 22 with print data and controls the print data transfer block 23 to transfer image data stored in the memory 22 to the head driver 24. The head driver 24 is controlled by the printer controller 21 to drive the ink jet head 1. Temperature information detected by the temperature sensor 18 is supplied to the printer controller 21.

If a driving signal is generated from the head driver 24 and applied to the piezoelectric member 15, according to this configuration, the piezoelectric member 15 displaces the vibration plate 14 to change the capacity of the pressure chamber 11. Thereupon, pressure waves are generated in the pressure chamber 11 to discharge ink drops through the nozzles 13. The resonance period of the ink meniscus in each nozzle 13 is equal to the Helmholtz resonance period of ink.

In the case where gradational printing is carried out according to the discharge frequency of ink droplets, the volume of ink droplets discharged in each cycle of operation should preferably be reduced to obtain high print quality. The shorter the Helmholtz resonance period of ink in the pressure chamber 11, moreover, the more quickly the ink drops can be discharged.

Since the Helmholtz resonance period of ink in the pressure chamber 11 can be increased by reducing the capacity of the chamber 11, it is to be desired that the capacity of the chamber 11 should be small enough.

Figure 4:
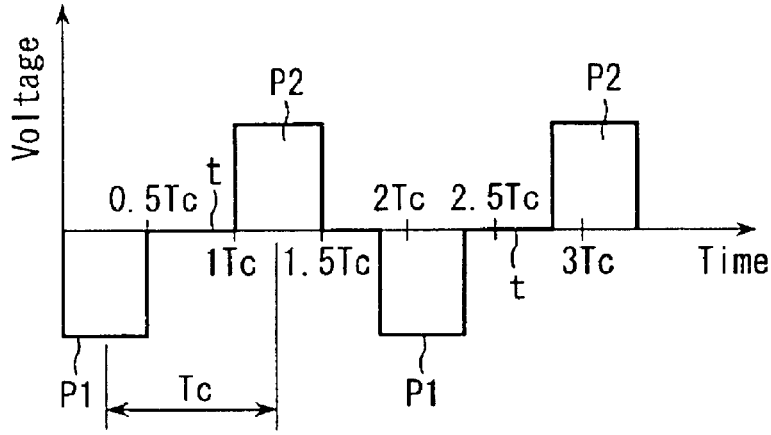
FIG. 4 is a waveform showing an example of a driving signal generated from the driving signal generator.

FIG. 4 is a waveform showing an example of a driving signal that is generated from the driving signal generator 2. This driving signal is formed of driving pulses each including an expansion pulse P1 for increasing the capacity of the pressure chamber 11, a latency t, and a contraction pulse P2 for reducing the capacity of the pressure chamber 11. The gradational printing is carried out with the number of ink drops to be discharged through the nozzles 13 controlled according to the number of the driving pulses. A fixed delay time is set between the driving pulses.

If the Helmholtz resonance period of ink or the resonance period of the ink meniscus is defined as Tc, a time lag between the respective centers of the expansion pulse P1 and the contraction pulse P2 is adjusted to Tc. Further, the pulse width of the expansion pulse P1 and the contraction pulse P2 is adjusted to Tc/2. Therefore, t is also adjusted to Tc/2.

Since the resonance period Tc of the ink meniscus changes depending on temperature, the time lag between the expansion pulse P1 and the contraction pulse P2 can be compensated according to the temperature detected by the temperature sensor 18. The printer controller 21 is provided with TABLE 1, for example, and serves to correct the time lag between the expansion pulse P1 and the contraction pulse P2 according to the resonance period Tc that corresponds to the temperature detected by the temperature sensor 18.

TABLE 1

| Temperature | Tc |
|---|---|
| 10° C. | 4.4 μs |
| 20° C. | 4.5 μs |
| 30° C. | 4.6 μs |
| 40° C. | 4.7 μs |

If the resonance period Tc of the ink meniscus changes depending on the ink temperature, therefore, the time lag between the respective centers of the expansion pulse P1 and the contraction pulse P2 can be compensated correspondingly. Accordingly, the time lag between the respective centers of the expansion pulse P1 and the contraction pulse P2 can always be adjusted to the resonance period Tc of the ink meniscus.

The operation will now be described with reference to FIGS. 5A, 5B, 5C, 5D and 6.

Figures 5A, 5B, 5C, 5D:
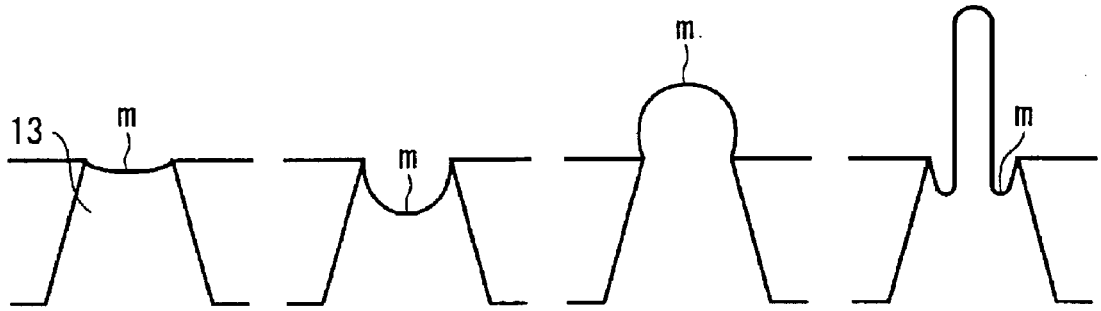
FIG. 5A is a diagram showing a meniscus in an initial state.
FIG. 5B is a diagram showing a meniscus in a state of 0.5 Tc after start of operation.
FIG. 5C is a diagram showing a meniscus in a state of Tc after start of operation.
FIG. 5D is a diagram showing a meniscus in a state of 1.5 Tc after start of operation.
Figure 6:
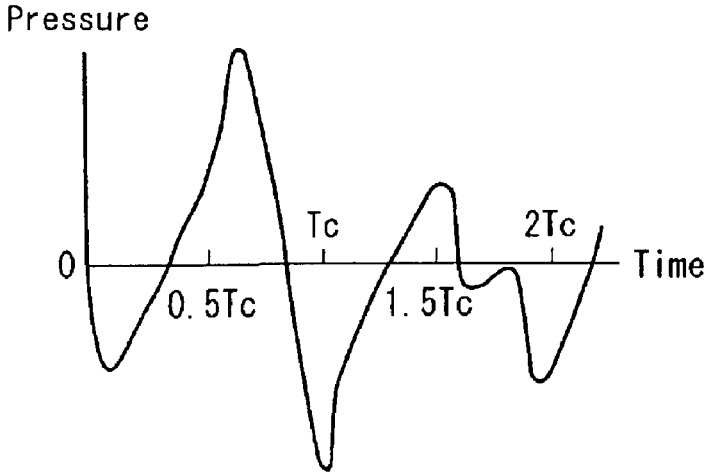
FIG. 6 is a graph showing change of ink pressure in a pressure chamber.

If the expansion pulse P1 is applied to the piezoelectric member 15 in an initial state such that an ink meniscus m in each nozzle 13 is in the status shown in FIG. 5A, the pressure chamber 11 expands so that the ink pressure in the pressure chamber lowers in the manner shown in FIG. 6. Thereupon, the ink meniscus m receives a negative pressure from the pressure chamber 11 and starts to recede, as shown in FIG. 5B.

Thereafter, the ink pressure in the pressure chamber 11 is increased to become a positive pressure by pressure vibration in the manner shown in FIG. 6. In a time equal to 0.5 Tc after the start of operation, the ink meniscus m receives the positive pressure from the pressure chamber and ceases to recede, thereby coming to a standstill. Since the expansion pulse P1 then also terminates, the pressure chamber 11 contract. When the pressure chamber 11 starts to contract, the ink pressure further increases to the highest level, whereupon the meniscus m receives the high pressure and is discharged through the nozzle 13.

Thereafter, the ink pressure in the pressure chamber 11 is lowered by pressure vibration. In a time equal to Tc after the start of operation, the discharge of the meniscus m terminates under the negative pressure from the pressure chamber 11. At this point of time, the meniscus m is in the state shown in FIG. 5C. The ink discharge through the nozzle 13 is continued by inertia.

When the time Tc elapses after the start of operation, application of the contraction pulse P2 is started. Thereupon, the capacity of the pressure chamber 11 is reduced so that the ink pressure increases, and the negative pressure lowers. Thereafter, the meniscus m receives the negative pressure from the pressure chamber 11 and recedes, whereupon the ink pressure is increased by pressure vibration.

In a time equal to 1.5 Tc after the start of operation, the meniscus m receives the positive pressure from the pressure chamber 11, recedes, and then comes to a standstill. At this point of time, the meniscus m is in the state shown in FIG. 5D. The ink discharge through the nozzle 13 is further continued by inertia, and a first ink drop is discharged. Since the contraction pulse P2 then also terminates, the pressure chamber 11 expands. When the pressure chamber 11 starts to expand, the ink pressure lowers, whereupon most of the pressure generated for the ink discharge is canceled. Thus, sudden advance of the meniscus m is restrained, so that involution of air bubbles can be prevented.

If the next driving pulses are continuously applied, thereafter, the process of operation in the initial state and the subsequent processes are repeated. In the operation for discharging the second ink drop and the subsequent ink drops, the meniscus temporarily recedes much deeper than in the case of the discharge of the first ink drop. Since the ink is supplied from the common pressure chamber 16 to the pressure chamber 11 owing to the surface tension of the meniscus, however, the meniscus never continues to recede if the ink drop discharged in the first cycle of operation is small.

Figure 7:
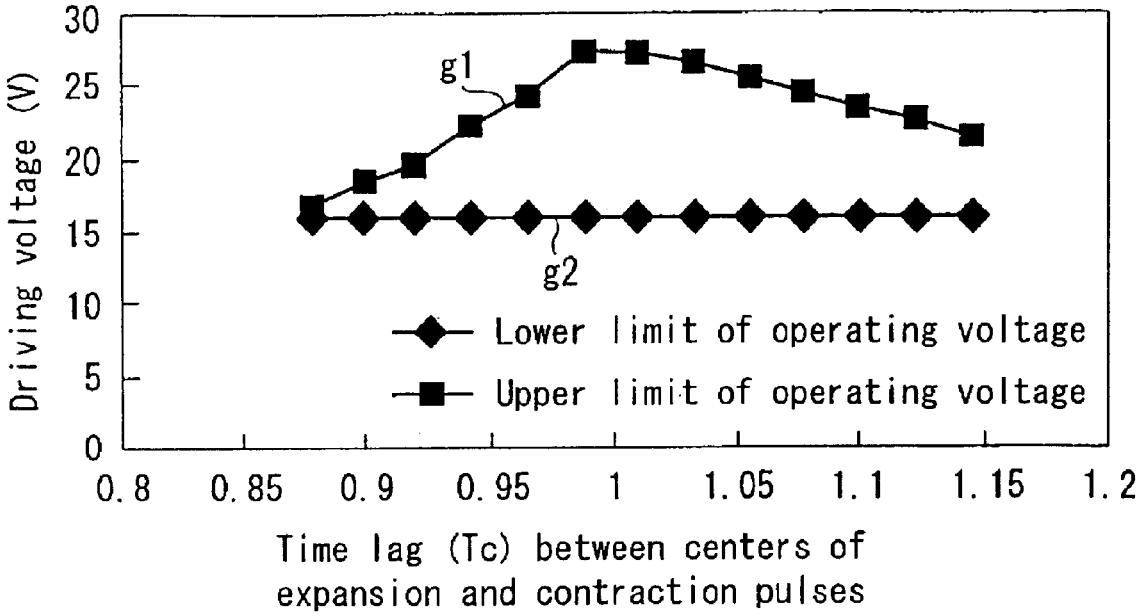
FIG. 7 is a graph showing the relation between driving voltage and a time lag between the respective centers of expansion and contraction pulses obtained when seven ink drops are continuously discharged.

FIG. 7 is a graph showing the relation between a driving voltage V and a time lag between the respective centers of the expansion and contraction pulses P1 and P2 obtained when seven ink drops are continuously discharged. Curves g1 and g2 represent the upper and lower limits, respectively of the operating voltage.

The lower limit of the operating voltage is the lower limit of the driving voltage at which normal printing can be carried out. If the driving voltage is lower than this lower limit, the speed of discharge of ink drops is so low that the positions of impact of the ink drops vary substantially, and the printing density is too low to maintain satisfactory print quality. On the other hand, the upper limit of the operating voltage is the upper limit of the driving voltage at which the operation can be performed with stability. If the driving voltage exceeds this upper limit, the ink in the pressure chamber 11 involves air bubbles, so that ink drops cease to be discharged.

Further, the graph of FIG. 7 indicates that the highest driving voltage can be used for the drive when the time lag between the respective centers of the expansion and contraction pulses P1 and P2 is equal to Tc or the resonance period of a meniscus that is generated in each nozzle. This implies that the ink drops can be discharged at high speed with the least air bubbles involved when the time lag between the respective centers of the expansion and contraction pulses P1 and P2 is equal or approximate to Tc. Even if the time lag between the respective centers of the expansion and contraction pulses P1 and P2 is somewhat deviated from Tc, according to this graph, moreover, a relatively high driving voltage can be used for the drive in a relatively wide range, especially in the region higher than Tc, so that the same function and effect can be obtained.

It is to be desired, therefore, that the expansion and contraction pulses P1 and P2 should be generated so that the time lag between their respective centers is equal to Tc. However, the time lag need not always be equal to Tc, and may be somewhat deviated from Tc. In short, it is necessary only that the expansion and contraction pulses P1 and P2 be generated so that the time lag between their respective centers substantially corresponds to the resonance period of the meniscus in each nozzle.

According to this embodiment, the ink jet recording apparatus can minimize the possibility of the ink in the nozzles 13 involving air bubbles when one pixel is subjected to gradational printing by continuously supplying the actuator with a plurality of driving signals such that the time lag between the respective centers of the expansion and contraction pulses P1 and P2 is made substantially equal to the resonance period Tc of the meniscus.

Further, the ink jet recording apparatus can correct the time lag Tc between the respective centers of the expansion and contraction pulses P1 and P2 in accordance with temperature information that is detected by the temperature sensor 18.

Although the driving pulses each of which is composed of the expansion pulse P1 with the pulse width equal to Tc/2, the latency Tc/2, and the contraction pulse P2 with the pulse width equal to Tc/2 and which are repeatedly generated with the fixed delay time have been described as an example of the driving signal that the driving signal generator 2 generates, the present invention is not limited to these signals.

Figure 8:
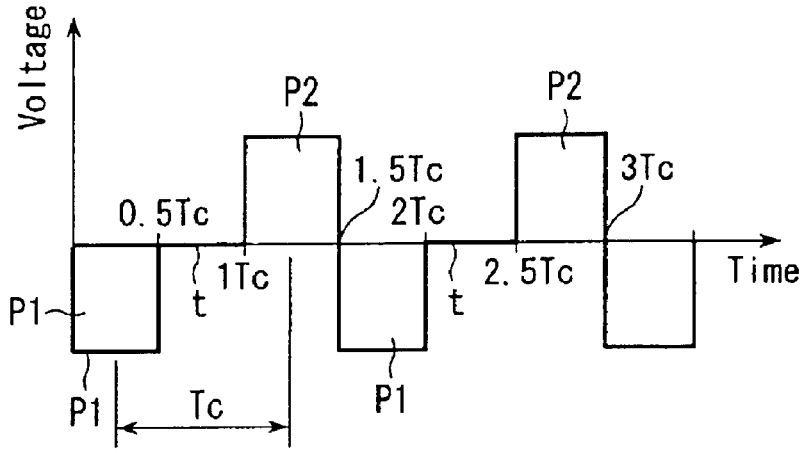
FIG. 8 is a waveform showing another example of the driving signal generated from the driving signal generator.

As shown in FIG. 8, for example, the driving signal generated from the driving signal generator 2 may be formed of driving pulses that are repeatedly generated without any delay time between them. In this case, generation of the contraction pulse P2 of one driving pulse is immediately followed by generation of the expansion pulse P1 of another driving pulse.

Figure 9:
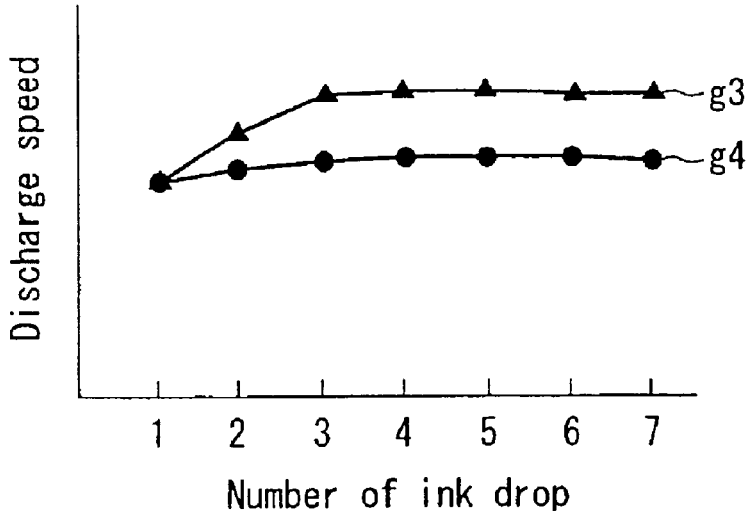
FIG. 9 is a graph showing the relation between the respective speeds of discharge of ink drops at which ink is continuously discharged a plurality of times to form one pixel.

If the delay time between the driving pulses is 0, as shown in FIG. 8, moreover, the speed of discharge of ink drops tends to increase according to number of ink drop, as indicated by curve g3 of FIG. 9.

Figure 10:
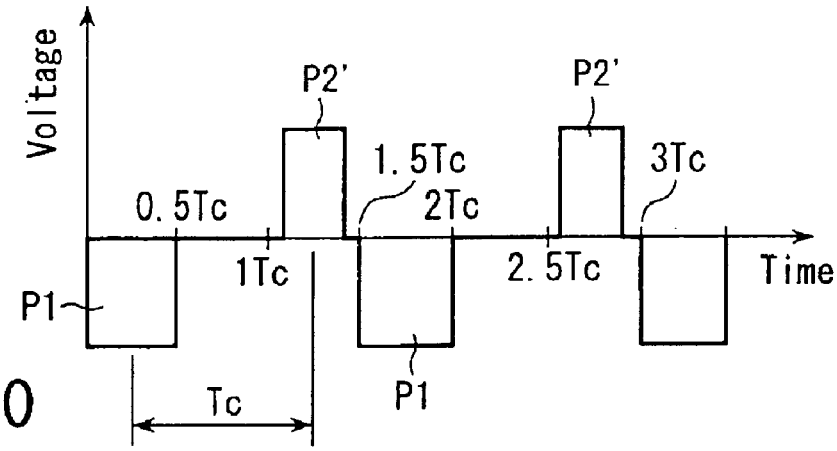
FIG. 10 is a waveform showing still another example of the driving signal generated from the driving signal generator.
Figure 11:
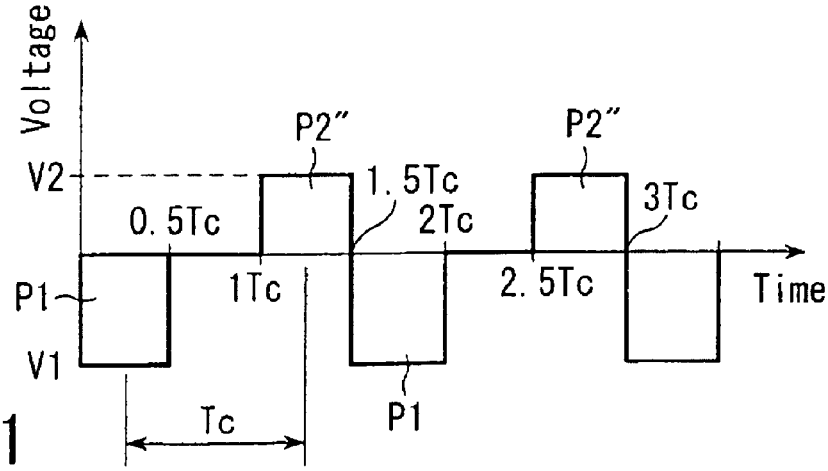
FIG. 11 is a waveform showing a further example of the driving signal generated from the driving signal generator.

To cope with this, a contraction pulse P2' with a pulse width shorter than Tc/2 may be used as the contraction pulse without changing the position of its center, as shown in FIG. 10. Alternatively, a contraction pulse P2" with a voltage V2 that is lower than the voltage V1 of the expansion pulse P1 may be used as the contraction pulse, as shown in FIG. 11.

A moderate increase of the discharge speed allows an ink drop discharged at a time to unite with its preceding ink drop in the air, thereby improving the circularness of dots dashed against a printing medium. If the discharge speed is increased too much, however, the discharge sometimes may be unstable. In this case, it is necessary only that the pulse width or voltage of the contraction pulse be narrowed or lowered to restrain the increase of the discharge speed. By doing this, the increase of the speed of discharge of subsequent ink drops can be restrained to maintain the stability of the ink drop discharge, as indicated by curve g4 of FIG. 9.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An ink jet recording apparatus comprising:

a pressure chamber for storing ink;

a nozzle fluidly coupled with the pressure chamber for discharging the ink from the pressure chamber;

an actuator for increasing and reducing the capacity of the pressure chamber in response to driving signals and continuously discharging a plurality of ink drops through the nozzle for gradational printing to form a single pixel on a recording medium; and a driving signal generator for successively generating, an expansion pulse for increasing the capacity of the pressure chamber and reducing the increased capacity, and a contraction pulse for reducing the capacity of the pressure chamber after a latency subsequent to the expansion pulse and increasing the reduced capacity with a timing such that a time lag between the respective, centers of the expansion pulse and the contraction pulse substantially corresponds to the resonance period of a meniscus generated in the nozzle by the ink in the pressure chamber to prevent involution of air bubbles from appearing in the ink.

2. An ink jet recording apparatus according to claim 1, further comprising a temperature detector for detecting the temperature of the ink in the pressure chamber, and wherein the driving signal generator compensates the time lag between the respective centers of the expansion pulse and the contraction pulse as the resonance period changes according to the temperature detected by the temperature detector.

3. An ink jet recording apparatus according to claim 1, wherein the width of the expansion pulse is adjusted to half of the resonance period of the meniscus generated in the nozzle.

4. An ink jet recording apparatus according to claim 2, wherein the width of the expansion pulse is adjusted to half of the resonance period of the meniscus generated in the nozzle.

5. An ink jet apparatus according to claim 1, wherein the width of the contraction pulse is shorter than the width of the expansion pulse.

6. An ink jet recording apparatus according to claim 1, wherein the amplitude of the voltage of the contraction pulse is lower than the amplitude of the voltage of the expansion pulse.

* * * * *